United States Patent [19]

Jaquet

[11] Patent Number: 4,656,483

[45] Date of Patent: Apr. 7, 1987

[54] SWITCHABLE ANTENNA FOR THE VHF AND UHF FREQUENCY BANDS

[75] Inventor: Hervé Jaquet, Paris, France

[73] Assignee: Avions Marcel Dassault-Breguet Aviation, Vaucresson, France

[21] Appl. No.: 654,488

[22] Filed: Sep. 26, 1984

[30] Foreign Application Priority Data

Sep. 28, 1983 [FR] France ..... 83 15399

[51] Int. Cl.[4] ..... H01Q 9/06; H01Q 1/28

[52] U.S. Cl. ..... 343/745; 343/750; 343/895; 343/708

[58] Field of Search ..... 343/705, 708, 745, 747, 343/749, 750, 876, 846, 895, 872; 455/121, 123, 129, 193

[56] References Cited

U.S. PATENT DOCUMENTS 3,852,759 12/1974 Felsenheld et al. ..... 343/745
4,343,001 8/1982 Anderson et al. ..... 343/745
4,564,843 1/1986 Cooper ..... 343/745

FOREIGN PATENT DOCUMENTS 567569 12/1958 Canada ..... 343/708

OTHER PUBLICATIONS

Cooper, "Airborne Low-VHF Antennas", Advisory Group for Aerospace Research & Development, 26th meeting held at the Oberfinanzdirektion, Munich, Germany, 26-19 Nov. 1973.

*Primary Examiner*—Eli Lieberman
*Assistant Examiner*—Michael C. Wimer
*Attorney, Agent, or Firm*—Watson, Cole, Grindle & Watson

[57] ABSTRACT

This invention concerns an antenna switchable between the VHF and UHF frequency bands. This antenna incorporates a capacitive element, disposed at a specified distance from a reflecting surface mounted on the body of the vehicle. For VHF, tuning is obtained by a fixed self-inductance in parallel and a variable self-inductance in series with the capacitive element. The latter comprises various sections which can be short-circuited by switches. For UHF, the variable self-inductance is totally short-circuited and the fixed self-inductance is disconnected by a switch; then, plates form, with the reflecting surface and the capacitative element, a "manchette" antenna. This switchable antenna can in particular be mounted on an airplane.

9 Claims, 8 Drawing Figures

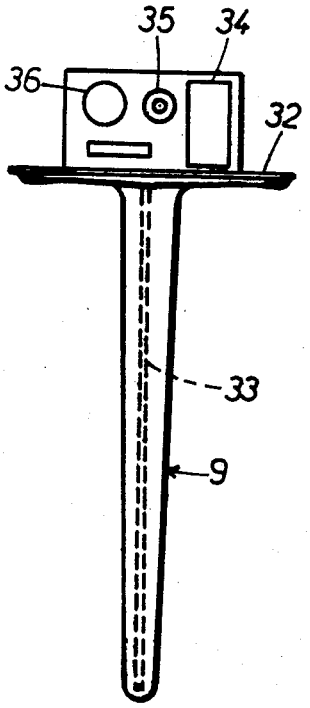
FIG.:6
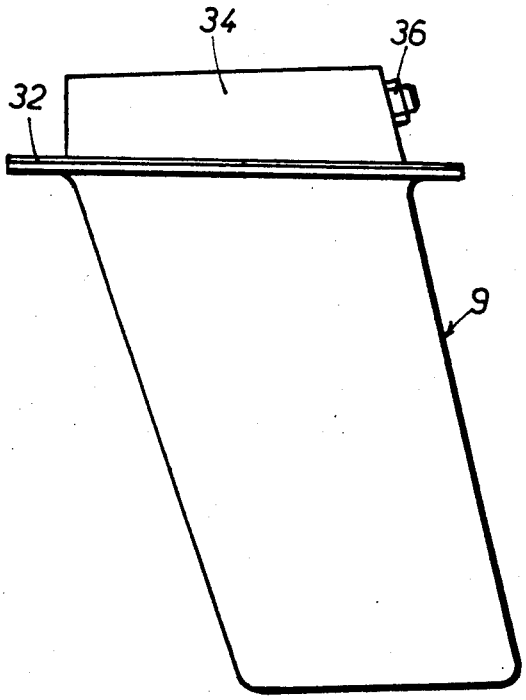
FIG.:7
FIG.:8
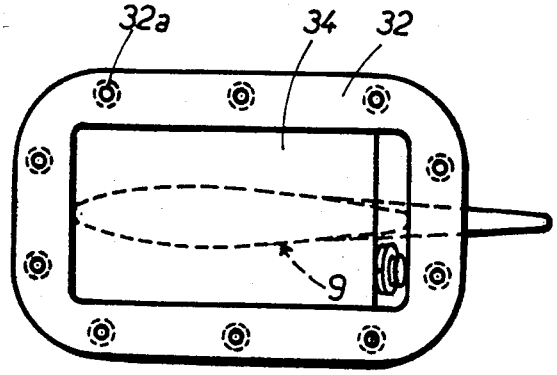

SWITCHABLE ANTENNA FOR THE VHF AND UHF FREQUENCY BANDS

BACKGROUND OF THE INVENTION

The present invention relates to a switchable antenna for the VHF and UHF frequency bands, intended in particular for aircraft.

Numerous aircraft, and especially military jet airplane, have to incorporate at one and the same time antennae for transmission and reception in the VHF band, in particular from 100 to 156 MHz, and in the UHF band, in particular from 225 to 400 MHz. For reasons especially of weight, it would be desirable to be able to use, for this application, one single transmitting and receiving antenna switchable between the two bands, VHF and UHF. The practical realisation of such a switchable antenna comes up against various problems, resulting more particularly from the large bandwidth and the long range required for the antenna.

In particular, the realisation of a passive antenna that is switchable between the VHF and UHF bands is not practicable, because of the large bandwidth to be covered. Nor is it practicable to use, for the application under consideration, an antenna adapted with lossy elements because such an antenna would offer too limited a range.

SUMMARY OF THE INVENTION

The switchable antenna for the VHF and UHF frequency bands according to the present invention is characterised in that it comprises a capacitive element spaced from a reflecting surface constituting ground; a first self-inductance, inserted between the capacitive element and a crossing point of the ground surface, connected to the transmitter/receiver and adaptable for VHF band use by short-circuiting of certain of its sections, and for UHF band use by short-circuiting of all its sections; a second self-inductance which a switch serves to connect between the first self-inductance and the earth surface for VHF band use and to disconnect for UHF band use; and also conductive side members inserted between the capacitive element and the ground surface on opposite sides of the self-inductances.

When the antenna according to the present invention is switched to the VHF band, its aerial is essentially composed of the capacitive element, spaced from the reflecting surface. It accordingly presents a small height in relation to the VHF wavelength to which the aerial is adapted, due to the appropriate choice of electrical size of the first self-inductance, by short-circuiting of certain of its sections. The aerial then offers an adequate bandwidth. As the adaptive self-inductances are inserted between the capacitive element and the reflecting surface, and are thus in some way a part of the aerial itself, they do not in practice cause any reduction in the bandwidth of the aerial, as would be the case if the two self-inductances were significantly spaced from the aerial, and connected to it by suitable cables. Furthermore, when the antenna according to the present invention is switched to the UHF band, its aerial is of the classic type, referred to as having manchettes or side members, the radiating element or blade consisting of the capacitive element itself. The self-inductances are then taken out of circuit, the first by short-circuiting of all its sections, and the second by disconnection. This very classic aerial offers satisfactory standing wave ratio, particularly in the UHF band from 225 to 400 MHz, without the need to use adaptive circuits consisting for example of self-inductances.

The present invention thus permits the realisation of a switchable antenna of the type indicated by means of a small number of simple components, forming a whole that is compact, light and of small dimensions, which is of particular advantage for application to aircraft.

The switches which are associated with the first self-inductance to short-circuit its different sections, and the switch which is associated with the second self-inductance to connect or disconnect it can in principle be of any type. One could for example envisage using small high-frequency relays. This solution would however present disadvantages of space taken up, of poor reliability in a harsh environment, and of over-long switching times. This is why, in a preferred form of implementation of the invention, the switches associated with the first and second self-inductances incorporate semiconductor diodes, preferably of the P-I-N type, which do not present any of the disadvantages mentioned. Such diodes in fact have very short switching times, high reliability, even in harsh environments, and a very modest bulk, which permits them to be soldered directly to appropriate points of the self-inductances without preventing the complete aerial from being compact and of modest dimensions.

For preference, the switch associated with each section of the first inductance incorporates at least one P-I-N diode, one electrode of which is connected directly to a turn at one end of the corresponding section, and the other electrode of which is connected, on the one hand, to a turn at the other end of said section via a capacitor for shunting VHF or UHF currents and, on the other hand, to a source of continuous biasing of the diode via a self-inductance for blocking VHF or UHF currents and a crossing point of the ground surface. When the polarisation source applies to the diode an inverse biasing voltage which is high enough, e.g. −250 volts, it is blocked, and so the VHF or UHF currents flow in the corresponding section of the first self-inductance. By contrast, when the dc bias power source supplies to the diode a direct current of sufficient magnitude, e.g. 100 milliamps, the diode is rendered conductive, and the VHF or UHF currents are shunted away from the corresponding section of the first self-inductance, via the shunt formed by the conducting diode, in series with the shunting capacitor, so that the said section of the first self-inductance is short-circuited for the VHF or UHF currents.

In a particularly advantageous form of implementation of the antenna according to the present invention, its different components are fixed, or constituted by circuits printed on one single electrically insulated board which also carries the first self-inductance and the second one, and which can be surrounded by a radome of modest width, which is given an aerodynamic profile. Such a combination can evidently be dimensioned in such a way as to present the modest weight and the modest bulk required for it to be fitted on an airplane, with the aerodynamic profile of the radome, which embraces the antenna, conferring on the whole a modest drag.

In this particularly advantageous embodiment, it would evidently be desirable for the first and second self-inductances to consist of circuits printed on one and the same electrically insulating board, and for the blocking self-inductances, associated respectively with the different sections of the first self-inductance, to be positioned in the immediate proximity of the corresponding diodes, the latter themselves being positioned in the immediate proximity of the second self-inductance. Although this embodiment of the antenna according to the present invention appears to offer the greatest advantages as far as compactness, low weight and low cost are concerned, experience and calculations have shown that it presents the following disadvantage: as has already been indicated above, when the antenna according to the present invention is switched to the VHF band, the height of its aerial is small in relation to the wavelength, so that the electrical equivalence circuit of the aerial contains a relatively small radiation resistance; in order to provide a sufficient power output from the antenna for the requisite range, it is thus necessary to feed its aerial with high-intensity VHF currents, which cause a voltage surge to appear at the terminals of the first self-inductance. Consequently, those at least of the blocking self-inductances which are associated with the sections of the first adaptive self-inductance which are furthest removed from the reflecting surface are subject to voltage surges liable to produce stresses between their neighbouring turns. Furthermore, the electrical values of these blocking self-inductances, intended to prevent the UHF and VHF currents from distorting the first self-inductance through the medium of the biasing conductors and of their capacities in relation to ground, are influenced by the VHF or UHF currents circulating in the first self-inductance, to which the said blocking self-inductances are adjacent. Finally, the VHF or UHF currents, being intense, would be passing via the first and second self-inductances, printed directly on to the insulating board, produce excessive heating of the first and second self-inductances.

This is why it is preferable for the adaptive self-inductances of the antenna according to the present invention not to consist of circuits printed on to a single electrically insulating board, but rather to consist of corresponding electrical components independent of the said board, though they may be supported by it. In particular, the first self-inductance is formed, for preference, by the helical winding of solid conductors, connected in such a way as to continuously bias the diodes associated with at least some of the sections of the first self-inductance, and of at least one hollow conductor, such as a metallic sheath, surrounding the solid conductors without contact and connected in such a way as to conduct only VHF and UHF currents.

With this embodiment, it is possible to position the blocking self-inductances at an appreciable distance from the first adaptive self-inductance, so that the said blocking self-inductances are not influenced by the VHF and UHF currents flowing in the first self-inductance; this assumes, of course, that the bias voltages are transmitted to the diodes associated with the differrent sections of the first self-inductance by conductors of appropriate lengths, preferably solid conductors; but, as the latter are surrounded by the metallic sheath, which conveys the VHF and UHF currents, they are screened from the influence of the latter and consequently from the over-voltages that they produce along the turns of the first self-inductance. Finally, however intense the VHF or UHF currents circulating in the metallic sheath wound in a spiral may be, they cannot induce in it excessive heating.

In practice, the first self-inductance of the antenna according to the present invention can be formed, for example, by the helical winding of coaxial cables, soldered by their sheaths and having lengths just sufficient to enable their respective central conductors to bias the diodes associated with at least some of its sections. In the case in which each diode associated with a section of the first self-inductance has an electrode connected directly to the end turn of the section which is furthest away from the reflecting surface, the longest coaxial cable can be replaced by one single simple conductor, either solid or hollow.

BRIEF DESCRIPTION OF THE DRAWINGS

By way of example, a description is given below, and illustrated in outline in the accompanying drawings, of an embodiment of the antenna according to the present invention. In the drawings:

FIGS. 6, 7 and 8 are front, side and plan views of the whole of the antenna of FIG. 5 and of its radome, in an embodiment capable of being mounted on the nose of a military jet airplane.

DETAILED DESCRIPTION OF THE DRAWINGS

Figure 2:
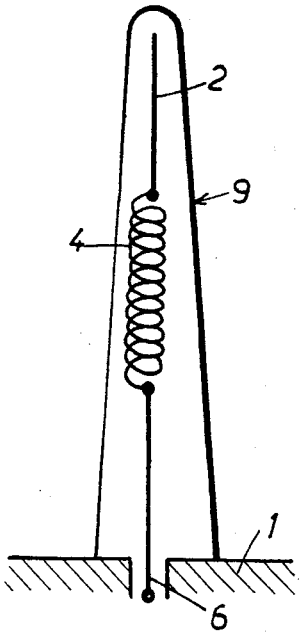
FIGS. 1 and 2 are, respectively, a view from the side and a view from the front showing this embodiment, much simplified and reduced to its main components.

In the outline FIGS. 1 and 2, 1 designates the ground of the antenna, which constitutes a reflecting surface for its aerial, and which is formed for example by its metallic base, as will be indicated in more detail below. 2 designates a capacitive element, for example a thin plate, perceptibly rectangular, made of copper, positioned at an appropriate distance from the reflecting surface 1; *3a* and *3b* designate two thin metal plates which are inserted between the reflecting surface 1, with which they respectively make contact along their corresponding edges, and the capacitive element 2, with which they do not make contact. 4 designates a first adaptive self-inductance, which is inserted electrically between the capacitive element 2 and a crossing point 6 of the ground surface 1, connectable, more particularly by a coaxial cable, to the output of a transmitter/-receiver capable of being switched to the VHF frequency band, in particular between 100 and 150 MHz, and to the UHF frequency band, in particular between 225 and 400 MHz.

Of course, the crossing point 6 could equally well be connected, by means of coaxial cables and a tee-piece union, to the respective outputs of a VHF transmitter/-receiver and another, UHF transmitter/receiver. The first self-inductance 4 incorporates, in the embodiment illustrated in FIG. 1, three sections each of which can be shunted by one of the switches *7a, 7b, 7c*. Another switch, 8, allows one of the terminals of a second adaptive self-inductance 5, whose other terminal is connected to the ground 1, to be connected to the crossing point 6. As can be seen in FIG. 1, the two self-inductances 4 and 5, as well as the switches *7a* to *7c* and 8 which are associated with them are disposed in the space between the components 1, 2, 3*a* and 3*b*, so that the antenna as a whole has a form that is compact and, as can be seen in FIG. 2, of modest width, and so that it can be inserted into a radome 9, all of whose dimensions, but above all its width (FIG. 2), are small.

Figure 1:
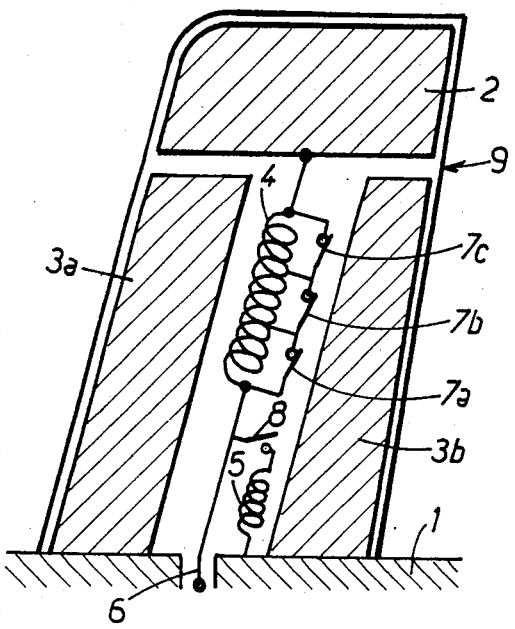
Figure 3:
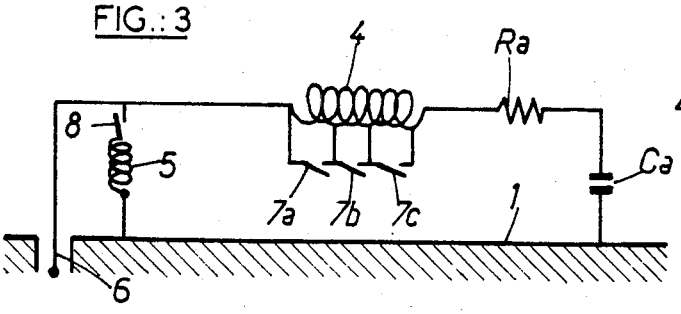
FIG. 3 is the electrical equivalence circuit diagram of the antenna of FIGS. 1 and 2.

In FIG. 3, which represents the electrical equivalence circuit diagram of the antenna of FIGS. 1 and 2, the components corresponding to those of FIGS. 1 and 2 have been marked with the same reference numerals: Ca designates the capacitance of the capacitative element 2 (FIGS. 1 and 2) in relation to the ground surface 1, and Ra designates the radiation resistance of the aerial.

The antenna according to the present invention, which has just been described with the help of FIGS. 1 and 2, functions in the following manner:

The switches 7*a*, 7*b*, 7*c* and 8 are controlled by known means, which have not been depicted in FIGS. 1 and 2 and which it is not necessary to describe in detail. An examplary embodiment of these means will be described below. The switching of the antenna of FIGS. 1 and 2 to the VHF band is achieved by closing the switch 8, which connects the second self-inductance 5 in parallel with the crossing point 6; the tuning of the antenna to the frequency of the VHF signals that it receives is obtained by switching the first self-inductance 4 to an appropriate value; this first self-inductance 4, in the case in which it is composed of three identical sections, that is to say each incorporating the same number of turns, can take on a maximum value when the three switches 7*a* to 7*c* are open, a minimum value when one only is open, and an intermediate value when two of the said switches are open. In general, the first self-inductance 4 incorporates a much larger number of sections, which may not be identical among themselves, and whose diverse combinations, corresponding to the diverse possible configurations of the switches associated with the said sections, allows a number of different values, much greater than three, to be given to the self-inductance 4. Of course, the different values that can thus be assumed by the first self-inductance 4, in series with the radiation resistance Ra, and the single value of the second self-inductance 5, in parallel with Ra, are chosen in such a way as to compensate for the reactance of the capacitance Ca, so as to minimise the standing wave ratio of the aerial, preferably making it lower than 2. In the VHF band, the active components are thus only the components 2, 4 and 5, the aerial consisting essentially of the capacitive element 2, separated from the reflecting surface 1 in such a way as to form a monopole of small height in relation to the wavelength, to which there corresponds (according to FIG. 3) a capacitative impedance having a fairly small resistive term, Ra. The large bandwidth obtained by this VHF aerial results in particular from the fact that the adaptive self-inductances, 4 and 5, are located in the immediate proximity of the other components, 1 and 2.

The functioning of the antenna of FIGS. 1 and 2 in the UHF band is obtained, when all the switches 7*a* to 7*c* are closed, so as to short-circuit all the turns of the first self-inductance 4, and, when the switch 8 is open, in such a way as to disconnect the second self-inductance 5. The only active components of the aerial are then the components 1, 2, 3*a* and 3*b*, the latter two constituting "manchettes", utilised classically in UHF antenna of this type, known as "sabre antennae". The UHF antenna obtained in this way has appropriate impedance for presenting a low standing wave ratio in the whole of the UHF band, for example from 225 to 400 MHz, that is to say it is possible to utilise this UHF antenna in a wide band of frequencies without its needing to be associated with switchable adaptive components such as self-inductances 4 and 5.

Figure 4:
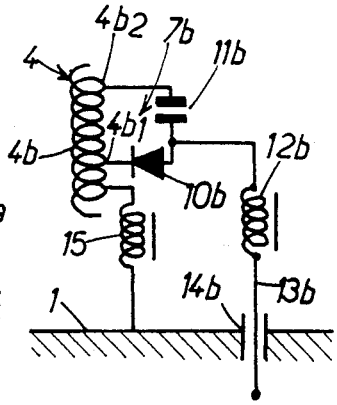
FIG. 4 is an electrical circuit diagram of an embodiment of a diode switch, associated with one of the sections of the first self-inductance of the antenna according to the present invention.

FIG. 4 is the electrical circuit diagram of an embodiment of one of the switches, for example 7*b*, which is associated with one of the sections, in particular 4*b*, of the first self-inductance 4. In this form of implementation, the switch 7*b* incorporates a semiconductor diode, 10*b*, preferably of the P-I-N type, one of whose electrodes, in particular the cathode, is connected directly to the end turn, 4*b*1, of section 4*b*, while its other electrode, in particular its anode, is connected, on the one hand, to the other end turn, 4*b*2, of section 4*b*, via a capacitor 11*b*, whose capacitance is chosen such that it produces a weak reactance for VHF and UHF currents, so that the latter are shunted via this capacitor 11*b* and the diode 10*b* when the latter is conductive which has the effect of deactivating section 4*b* of the first self-inductance 4: the anode of the diode 10*b* is on the other hand connected to a source of continuous biasing, via a self-inductance, 12*b*, whose value is chosen such that it produces a very high reactance in the VHF and UHF bands, so as to avoid shunting of the VHF or UHF currents, flowing in the shunt 10*b*–11*b* when the diode 10*b* is conductive at least partially towards the biasing source; the latter, which is not shown in FIG. 4, is connected by suitable means, which are known, and likewise are not shown, to the end of a conductor 13*b*, which is connected in series with the blocking self-inductance 12*b*, and which crosses the ground surface 1 at a crossing point 14*b* of specified capacitance. The self-inductance 15, which is inserted between the earth surface 1 and one of the turns of the first self-inductance 4, serves to return to ground the polarisation current which has passed through the diode 10*b* to render it conductive, while still avoiding, due to its high reactance, shunting to ground of the VHF or UHF currents which flow in the first self-inductance 4. If the diode 10*b* is for example of the DH438-08 type, it can be rendered conductive by supplying to the conductor 13*b* for example a direct current of 100 milliamps, and it can be blocked by applying to the same conductor for example an inverse voltage of −250 V.

Figure 5:
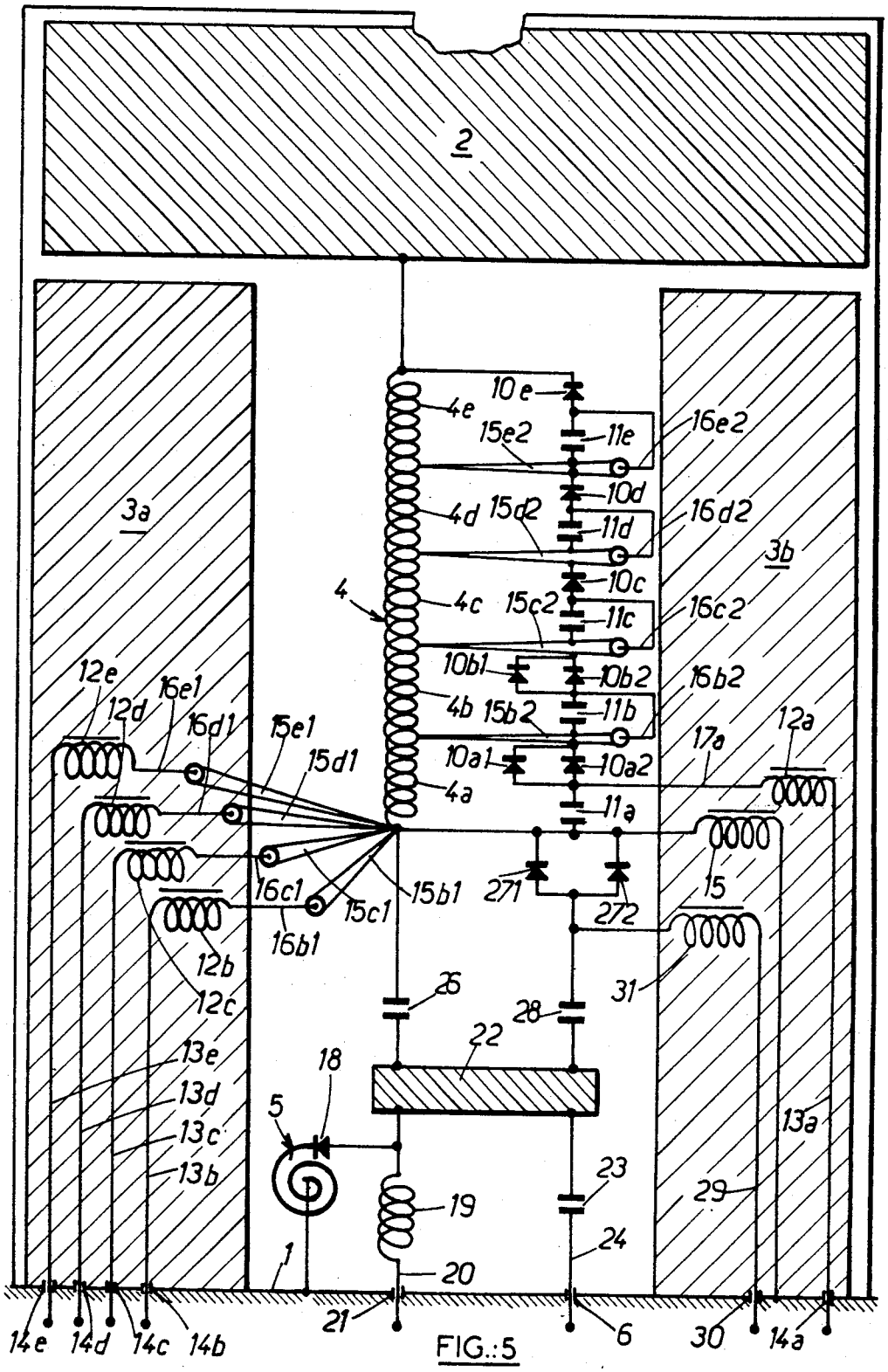
FIG. 5 is a side view corresponding to FIG. 1 and showing the whole of the components of the antenna according to the present invention.

FIG. 5 represents in outline a form of implementation of the antenna according to the present invention, in which the first self-inductance 4 comprises five sections, 4*a* to 4*e*, with each of which is associated a P-I-N diode switch of the type illustrated in FIG. 4. It is thus unnecessary to describe again the composition of each of these switches: suffice it to say that the switches associated with the two sections of the self-inductance 4, those nearest to the ground surface 1, that is to say sections 4*a* and 4*b*, incorporate switches which are each provided with two P-I-N diodes, for example 10*a*1 and 10*a*2, connected in parallel with one another, and preferably identical among themselves, so that the biasing current is divided approximately equally between them: this arrangement has the advantage of limiting the thermal power dissipated at the level of one junction of each P-I-N diode.

In the preferred form of implementation, which is illustrated in FIG. 5, the first self-inductance, 4, which comprises five sections, 4*a* to 4*e*, is formed by the helical winding of four coaxial cables, soldered by their sheaths, and by a simple conductor, solid or hollow, whose external diameter is preferably close to that of the coaxial cables, to whose sheaths it is likewise soldered. The four coaxial cables, the first ends of the metallic sheaths of which have been designated 15b1 to 15e1 respectively, as well as the simple conductor, are of different lengths, for example in arithmetical progression so that the four sections 4a to 4e of the self-inductance 4 each incorporate the same number of turns, of the same diameter, so that each section can be seen to correspond to one-fifth of the value of the total self-inductance. In these conditions, section 4a, the one nearest to the ground surface 1, is formed by helical winding in juxtaposition of the four coaxial cables and the simple conductor, section 4b is formed merely by helical winding of the three end coaxial cables 15c1 to 15e1 and of the simple conductor . . . etc., section 4d being formed by helical winding of the single end coaxial cable 15e1 and of the simple conductor, which in itself alone constitutes the fifth section, 4e. The second ends of the sheaths of the four coaxial cables which in practice scarcely emerge from the helical windings have been designated 15b2 to 15e2, while in FIG. 5 these ends have been depicted in a very elongated form, to make the figure more legible; the second end, for example 16b2, of the central conductor of each coaxial cable, for example of the one whose second sheath end is designated 15b2, is connected to the common point of the anode of the diodes 10b1 and 10b2 and of the VHF and UHF current shunt condenser, 11b, of the switch associated with the immediately following section of the self-inductance 4, for example its section 4b. In the same way, the second end, 16e2, of the central conductor of the coaxial cable whose second sheath end is designated 15e2 is connected directly to the common point of the single diode 10e and of the shunt condenser 11e of the switch associated with section 4e which is formed exclusively by winding of the end part of the simple conductor. In practice, each cathode of the diode or diodes associated with one of the five sections, as well as one of the plates of the corresponding shunt capacitor, is soldered respectively to the corresponding ends of the coaxial cables, as near as possible to the helical windings constituting the self-inductance 4.

On the other hand, the first ends, 16b1 to 16e1, of the central conductors of the four coaxial cables whose first sheath ends are designated 15b1 to 15e1, are connected, in series respectively with blocking self-inductances 12b to 12e, to conductors 13b to 13e which traverse the ground surface 1 via crossing points 14b to 14e, beyond which the ends of the said conductors 13b to 13e can be connected respectively to the outlets of a biasing device, which will be described in greater detail below, and which is capable of applying suitable continuous bias voltages to the said conductors 13b to 13e. These continuous bias voltages, which may for example have the values indicated previously, are transmitted, via the blocking self-inductances 12b to 12e, by the central conductors of the four coaxial cables, to the anodes of the diodes of the switches associated respectively with sections 4b to 4e of self-inductance 4. The anodes of the pair of diodes, 10a1 and 10a2 of the switch associated with section 4a, per contra, receive their continuous bias voltages, via the blocking self-inductance 12a, directly by way of a simple conductor 17a.

Due to the arrangement which has just been described, the VHF or UHF currents which flow in the sheaths of the coaxial cables have no influence on their central conductors, where the biasing currents flow; consequently, the VHF or UHF voltage applied to the second end of each of the central conductors is perceptibly the same as that applied to its first end, since the high frequency voltages applied respectively between 15b2 and 16b2, between 15c2 and 16c2, between 15d2 and 16d2, and between 15e2 and 16e2 are in practice nil: thus one avoids the subjection of the blocking self-inductances 12b, 12c, 12d and 12e to very high VHF or UHF over-voltages, which would be liable to damage them or to disturb their functioning. On the other hand, the P-I-N diodes 10b1, 10b2, 10c and 10d bear over-voltages when they are blocked. Furthermore, the VHF or UHF currents which flow in the sheaths of the four coaxial cables do not give rise to any heating harmful to the latter, as would be the case if they flowed in windings printed on an insulating board.

The electrical circuit of the antenna illustrated in FIG. 5 incorporates the following components besides: the second adaptive self-inductance, 5, which can consist of a single coaxial cable or of a conductive winding, printed on an insulating board, coupled at one end directly to the ground surface 1. Its other end is connected to the cathode of a diode 18, for example of the P-I-N type, whose anode can receive continuous bias voltages, via a blocking self-inductance 19, by way of a conductor 20 which traverses the ground surface 1 at a crossing point 21. The anode of the diode 18 is connected to a common electrical point, which can be formed by a conductive strip, made for example of copper, 22, and to which is connected, via a capacitor 23, presenting a weak impedance for VHF and UHF currents, a conductor 24 which traverses the ground surface 1 via the crossing point 6 and which can be coupled to the outlet or outlets of one or more VHF and UHF transmitter/receivers, by means not shown, in particular coaxial cables. Finally, a capacitor 26, whose reactance is selected to provide a precise match to the UHF band, is inserted between the common electrical point 22 and the end of the first self-inductance 4 nearest to the ground surface 1, that is to say the ends, 15b1 to 15e1, of the sheaths, soldered among themselves, of the four coaxial cables. In parallel with this capacitor 26 there is mounted a diode switch which allows it to be short-circuited in the VHF band; in the form of implementation illustrated, this switch consists essentially of a pair of diodes, 271 and 272, for example of P-I-N type whose cathodes are connected to the end of section 4a of the self-inductance 4, the nearest to the ground surface 1, while their anodes are connected in parallel to the common electrical point 22, via a capacitor 28, presenting a weak reactance for VHF currents. A conductor 29, traversing the ground surface 1 via a crossing point 30, allows suitable continuous bias voltages to be applied to the anodes of the diodes 271 and 272 via a blocking self-inductance 31.

The antenna illustrated in FIG. 5 and described above functions in the following manner: for operation in the VHF band, a suitable continuous bias voltage, more particularly a direct current of suitable intensity, is transmitted via the conductor 29 to the diodes 271 and 272 in such a way as to render them conductive and to short-circuit the capacitor 26. The adaptation of the value of the first self-inductance 4 to the VHF frequency, of transmission or of reception, which has been selected results from the application of direct bias currents to those of the conductors 13a to 13e which correspond to those of the sections 4a to 4e that have to be short-circuited by the corresponding diodes and shunt capacitor, while inverse blocking voltages are applied to the other diodes, by means of the corresponding conductors. As has already been shown, the direct bias currents return to the ground by means of the sheaths of the coaxial cables, to which the cathodes of the diodes mentioned are connected, as well as via the blocking self-inductance 15. Finally, a suitable direct current is supplied, by means of the conductor 20, to the diode 18, so as to render it conductive and thus to insert the second self-inductance 5 into the adaptive circuit, via the common electrical point 22.

For operation in the UHF band, on the other hand, direct bias currents are supplied to all the conductors 13*a* to 13*e* to render conductive the diodes of the switches associated with all the sections, 4*a* to 4*e*, of the first self-inductance, 4, which is thus totally short-circuited. An inverse blocking voltage is applied to the diodes 271 and 272 by the conductor 29, so that the capacitor 26 is not short-circuited. Similarly, a blocking voltage is applied by the conductor 20 to the diode 18, which thus isolates the second self-inductance 5 from the rest of the circuit.

As has already been shown, the components 2, 3*a*, 3*b* and 5 are composed preferably of metallic deposits, more particularly copper deposits, on an electrically insulating board, for example a synthetic resin loaded with glass fibres; the other components, 10*a*1 to 10*e*, 11*a* to 11*e*, 12*a* to 12*e*, 18, 19, 23, 26, 271, 272 and 28, like the four coaxial cables and the simple conductor, constituting the first self-inductance 4, can equally be carried by the same insulating board, being arranged in relation to elements 1, 2, 3*a* and 3*b*, preferably as illustrated in FIG. 5.

FIGS. 6 to 8 show the external appearance of an antenna according to the present invention, intended in particular to be fixed below the nose of a military jet airplane. 32 designates a metal plate below which there is fixed the radome 9, whose aerodynamic profile can be seen well, especially in the plan view of FIG. 8. The edges of the metal plate 32 are perforated by holes, such as 32*a*, for bolts to pass through to fix the said plate to the skin of the aircraft. The plate 32 is joined to the body of the aircraft in such a way as to form the reflecting surface of the aerial, designated 1 in the figures previously described. FIG. 6 shows in dotted lines the section of the electrically insulating board on which all the components of the antenna, previously described, are printed or fastened. On the surface of the plate 32 opposite the radome 9 a metal casing 34 is fixed, which is thus mounted underneath the skin of the aircraft; the lower surface (in FIGS. 6 to 8) of the casing 34 consists of the metal plate 32, on which the insulating board 33 and the radome 9 are fixed on edge. On the front face of the casing 34, which can be seen in FIG. 6, are fixed a coaxial connector 35 which is connectable by a coaxial cable—not shown—to the coaxial output(s) or input(s) of one or more VHF and/or UHF transmitter/receivers, as well as a multipin connector 36.

Inside the casing 34 different devices are mounted of which one form of embodiment will be indicated by way of non-restrictive example: this involves first of all a decoder of signals indicating the tuning frequency of the antenna and originating for example from the transmitter/receiver, by way of certain pins of the connector 36, for example in the known format referred to as "ARINC Series". This decoder produces switching signals whose use will be shown a little further on. The casing 34 also contains a converter for the electrical supply current which it receives by way of other pins of the connector 36, originating for example from the on-board generator of the aircraft, at 28 V D.C. This converter produces, for example on two distinct terminals, a current which can rise to 2 amps at a voltage of +5 V, and a current which can rise to 150 microamps at a voltage of −250 V. The casing 34 finally contains a selector, generally electronic, which can be a circuit of a known type, which need not be described; this selector is linked to two output terminals of the converter of the current supply, and receives also the switching signals produced by the decoder; it is set up in such a way as to apply to at least certain of the lines 13*a* to 13*e*, 20 and 29 (FIG. 5) direct currents of for example 100 milliamps or inverse voltages of for example −250 V, in terms of the switching signals which it receives from the decoder.

The present invention is not limited to the embodiments described above: it embraces all of their variants, of which a few only will be indicated below, by way of non-restrictive example:

The casing 34 and the circuits that it contains are susceptible to numerous different embodiments. The form and the arrangement of the base 32 and of the radome 9 are matters for choice. In the case of a terrestial antenna, or one intended for vehicles, whose weight and bulk requirements are less strict, the different components could be distributed on several insulating boards, or could even all be composed of discrete components, including the components 2, 3*a* and 3*b*, which could then be copper plates of greater or lesser thickness. Instead of comprising identical sections, the first self-inductance 4 could comprise sections which differ from one another in such a way as to be switchable to values forming for example a binary progression. In the case of the embodiment illustrated in FIG. 5, the longest simple conductor, intended to form by itself the section 4*e*, could be replaced by a fifth coaxial cable, whose sheath would then be connected to the cathode of the diode 10*e*, and its central conductor to its anode, the ends 16*e*2 to 16*b*2 of the centrral conductors of the four other coaxial cables then having to be connected respectively to the anodes of the diodes 10*d*, 10*c*, 10*b*1–10*b*2, and 10*a*1–10*a*2; in this case, of course, the blocking inductance 12*a* would have to be connected to the other end of the central conductor of the extra coaxial cable. The continuous bias signs could be inverted, given corresponding inversions of the diodes 10*a*1 to 10*e*, 18, 271 and 272. The first self-inductance 4 could also be constituted by the helical winding of a single coaxial cable, presenting the following characteristic structure: it would comprise solid conductors equal in number to the sections of the self-inductance 4 and a single metal sheath, surrounding without contact all these solid conductors, which could for example be insulated from it by solid insulation. Of course, each of the solid conductors would have to traverse the sheath via an insulating crossing point, to proceed to apply the continuous polarisation to the diode of the switch associated with one of the two nearest sections. As has already been indicated, each of the switches associated with one of the sections of the first self-inductance 4 could incorporate, instead of one or two P-I-N diodes, another switching component, adapted to VHF and UHF frequencies, whether it be a solid state component or a component of anther type, for example electromagnetic.

What is claimed is:

1. An antenna switchable between VHF and UHF frequency bands, comprising:

a reflecting surface constituting a ground;

a capacitative element spaced from said reflecting surface;

a first insulated conductor passing through said reflecting surface and connectable to a transmitter receiver adapted to be switched between VHF and UHF frequencies;

a first self-inductance comprising at least in part by at least one hollow, helically wound conductor and electrically inserted between said capacitive element and said first insulated conductor, and including several sections;

a second insulated conductor passing through said reflecting surface;

a plurality of first switches, each corresponding to one of said several sections for short-circuiting a respective section, and comprising at least one P-I-N diode having a first electrode connected to a first end point of said corresponding section and a second electrode connected to a second end point of said corresponding section through a capacitor having low resistance for VHF and UHF frequencies, and also connected to said second insulated conductor;

means for continuously biasing said diode via a self-inductance connected to a conductor which is helically wound and surrounded without contact by said hollow conductor and connected to said second insulated conductor;

a second self-inductance connected between said first self-inductance and said reflecting surface;

a second switch connected to said second self-inductance and adapated to be disconnected from said first self-inductance; and conductive side members inserted between said capacitive element and said reflecting surface on opposite sides of said first and second self-inductances and connected to said reflecting surface.

2. An antenna according to claim 1, wherein a capacitor to adapt the antenna for UHF band use is inserted between the corresponding ends of said first and second self-inductances, and a switch comprising at least one P-I-N diode is connected in parallell with said capacitor.

3. An antenna according to claim 1, wherein a single electrically insulated circuit board carries said first and second self-inductances, and is surrounded by a radome which has an aerodynamic profile.

4. An antenna according to claim 3, wherein circuit components of the antenna are printed on said circuit board.

5. An antenna according to claim 3, wherein said circuit board and the radome have their bases fixed on edge by a metal plate which forms a part of said reflecting surface, and a casing is fixed on said metal plate opposite said circuit board and radome.

6. An antenna according to claim 1, wherein said first self-inductance partly consists of sheaths of coaxial cables, said sheaths being electrically connected with one another, and said conductor is the inner wire of said coaxial cables corresponding to the preceding section of said self-inductance in the direction of said capacitive element.

7. An antenna according to claim 1 wherein said first self-inductance consists of a plurality of coaxial cables of different length and a simple cable longer than any of said coaxial cables, the sheaths of said coaxial cables and said simple cable being electrically connected together with all said cables having one end at the same point, and the inner wires of said coaxial cables are connected by one end to said second electrodes of said P-I-N diodes and by the opposite end to said self-inductance for blocking VHF and UHF signals, and the end of said sections of said first self-inductance are the ends of the sheath of said at least one of said coaxial cable and said simple cable.

8. An antenna according to claidm 1 wherein said sections of said first self-inductance are identical in length.

9. An antenna according to claim 1 wherein said sections of said first self-inductance are different from one another in length.

* * * * *